US008622263B2

(12) United States Patent
Su

(10) Patent No.: US 8,622,263 B2
(45) Date of Patent: Jan. 7, 2014

(54) BACKPACK STRUCTURE HAVING LIFESAVING FUNCTION

(76) Inventor: Lao-Ching Su, Taichung (TW)

( * ) Notice: Subject to any disclaimer, the term of this patent is extended or adjusted under 35 U.S.C. 154(b) by 240 days.

(21) Appl. No.: 13/005,696

(22) Filed: Jan. 13, 2011

(65) Prior Publication Data

US 2012/0006865 A1 Jan. 12, 2012

(30) Foreign Application Priority Data

Jul. 8, 2010 (TW) ..... 99213093 U

(51) Int. Cl.
*A45F 4/02* (2006.01)

(52) U.S. Cl.
USPC ..... 224/153; 224/148.4; 224/259; 224/627; 441/88; 441/125

(58) Field of Classification Search
USPC ..... 224/575, 153, 148.1, 148.4, 259, 627; 441/88, 125
See application file for complete search history.

(56) References Cited

U.S. PATENT DOCUMENTS

| | | | | |
|---|---|---|---|---|
| 65,901 | A * | 6/1867 | Golding | 441/35 |
| 4,973,277 | A * | 11/1990 | Khanamirian | 441/88 |
| 2005/0258201 | A1* | 11/2005 | Willows et al. | 224/148.4 |
| 2006/0043135 | A1* | 3/2006 | Lindsey | 224/576 |
| 2009/0127299 | A1* | 5/2009 | Jamlang | 224/153 |
| 2011/0240692 | A1* | 10/2011 | Park | 224/155 |

* cited by examiner

*Primary Examiner* — Nathan J Newhouse
*Assistant Examiner* — Scott McNurlen
(74) *Attorney, Agent, or Firm* — Rosenberg, Klein & Lee

(57) ABSTRACT

A backpack structure having a lifesaving function is made of material capable of floating on water. Connection straps are provided on each end surface of the backpack, which can be buckled with connection straps of another backpack and which can be buckled with connection straps of a water bag filled with air inside. The backpack structure enables users to cross rivers more safely, so as to increase survival possibility in the field, and also to carry personnel, goods or conduct emergency relief on water.

7 Claims, 9 Drawing Sheets

BACKPACK STRUCTURE HAVING LIFESAVING FUNCTION

BACKGROUND OF THE INVENTION

1. Field of the Invention

The present invention relates to a backpack structure having a lifesaving function, more particularly to a novel backpack structure having a lifesaving function by which users can not only cross rivers safely so as to increase survival possibility in the field, but also personnel goods can be carried or emergency relief can be conducted on water. Therefore, the present invention can increase the practical effect and characteristics of the backpack structure.

2. Brief Description of Prior Art

Ordinary folk hiking in suburbs or military personnel conducting wilderness survival training in mountain area often carry backpacks. As a backpack has a plurality of accommodation spaces for receiving various goods and it can be carried on the back of user, not only can a user's both hands be freed up to swing freely so as to make the user feel less fatigued while hiking, but also having empty hands make it easy to grab another object, so as to facilitate walking safely on steep and rugged terrain. It is this reason that has made a backpack become popular and its popularity is widespread.

Although the above described backpack can achieve the above expected effects, it is, however, found in its practical implementation that the conventional backpack only has the simple function of carrying various goods for users. Thus, it appears to be a monotonic product with respect to diversification of society nowadays in pursuit of innovation and change. Additionally, these conventional backpacks are incapable of floating on water, such that the backpack will sink when immersed in water when users are wading or crossing a river. This will result in a great inconvenience in usage; therefore the design of the overall structure still has room for improvement.

In view of the above disadvantages, the inventor of the present invention hereby proposes a novel backpack structure having a lifesaving function according to state-of-art research and improvements on the conventional structure and based on his abundant experience of R&D and manufacturing in relevant field and skillful contemplation in many ways.

SUMMARY OF INVENTION

This invention relates to a backpack having a lifesaving function which is made of material capable of floating on water. Connection straps are provided on the end surfaces of the backpack, which can be buckled with connection straps of the other backpack and which can be buckled with connection straps of a water bag filled with air inside. Configuring the backpack like this, not only can users cross rivers safely by means of the backpack structure, so as to increase the possibility of survival in the field, but also users can carry personnel, goods or conduct emergency relief on water. Therefore, the invention's implementation can increase the practical effect and characteristics of a backpack.

DETAILED DESCRIPTION OF PREFERRED EMBODIMENTS

The objects, the technical content and the expected effectiveness of the present invention will become more apparent from the detailed description of the preferred embodiments in conjunction with the accompanying drawings.

Figure 1:
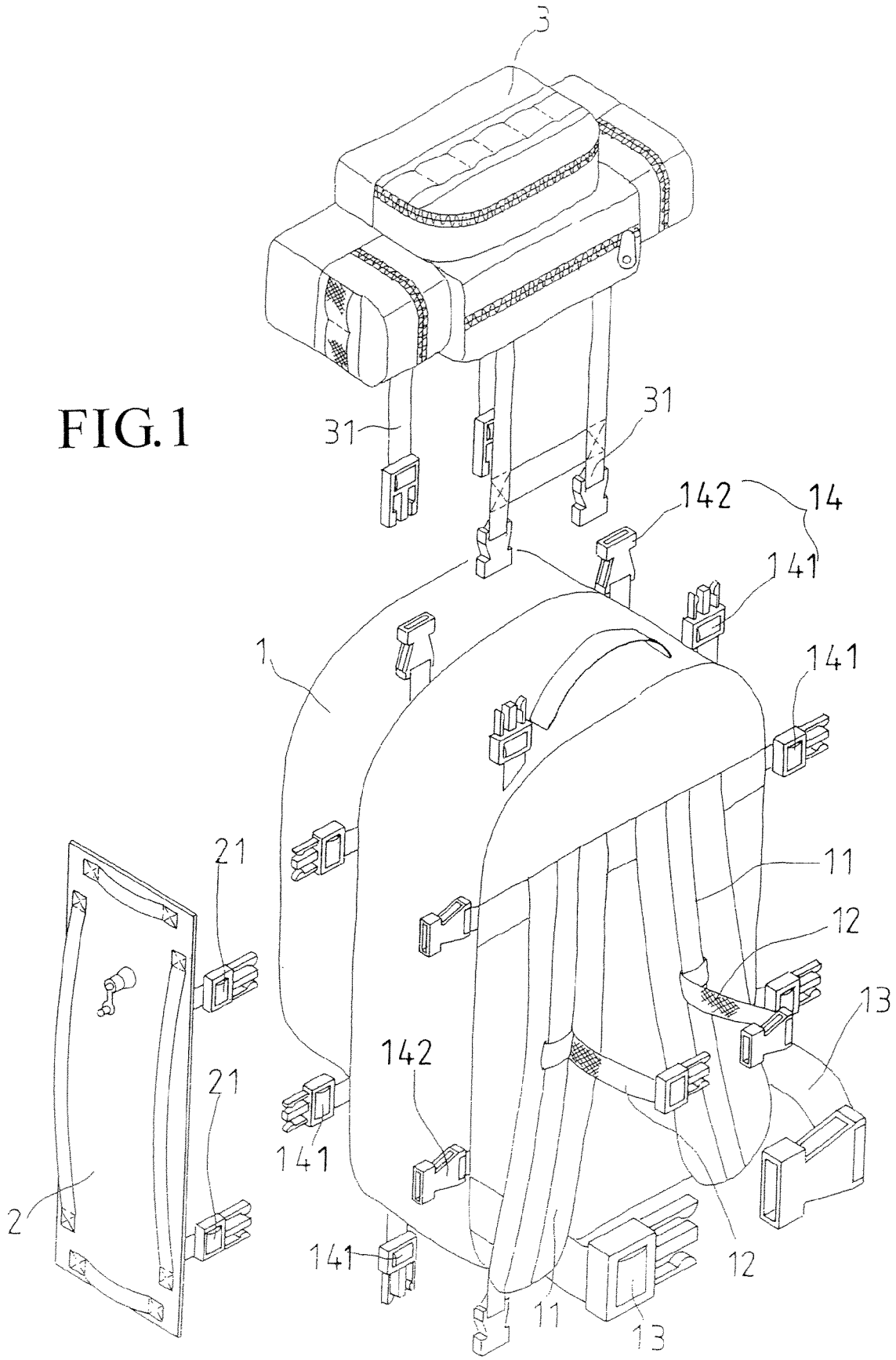
FIG. 1 is a perspective exploded view showing the backpack embodying the present invention.

Firstly, referring to FIG. 1, the backpack having a lifesaving function of the present invention comprises a backpack (1), water bags (2) and a sub-backpack (3).

Figure 2:
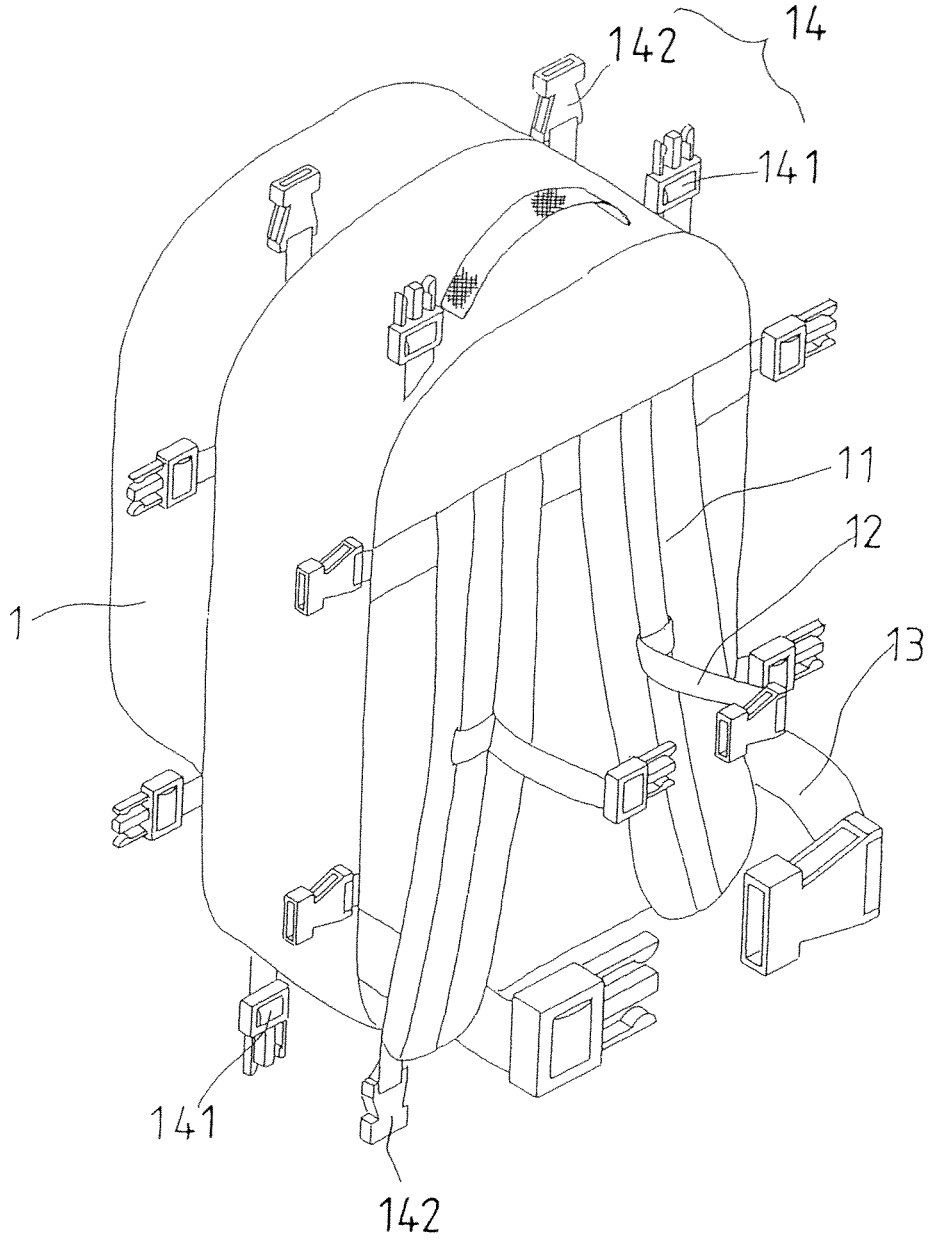
FIG. 2 is a perspective view showing the backpack of the present invention.

As shown in FIGS. 1 and 2, the backpack (1) is made of materials capable of floating on water, such as plastic materials, EVA etc. The backpack (1) has many accommodation spaces for receiving various goods, and two shoulder straps (11) are provided on the inner end face thereof. Chest straps (12), capable of buckling together, are connected between the two shoulder straps (11) and waist straps (13), also capable of buckling together, are provided at the lower edges on both sides of the inner end faces thereof. When a user carries the backpack (1) on his back by the shoulder straps (11), he can allow the backpack (1) to be carried more stably on his back by simultaneously buckling the chest straps (12) at his chest and the waist straps (13) at his waist. In addition, connection straps (14) are also provided on upper, lower, left and right end surfaces of the backpack (1), which can be buckled with connection straps (14) of another backpack (1).

The water bags (2) are received in the interior of the backpack (1). A closed space for filling with either water or air can be formed in each water bag (2). Further, connection straps (21) corresponding to the connection straps (14) of the backpack (1) are respectively provided on both sides of each water bag (2) in such a manner that the connection straps (14) on both sides of the backpack (1) can be buckled with connection straps (21) of two corresponding water bags (2).

The sub-backpack (3) is similarly provided with several accommodation spaces for receiving various goods. Connection straps (31) corresponding to the connection straps (14) of the backpack (1) are also provided on the sub-backpack (3) so that the sub-backpack (3) can be combined with the backpack (1) by the buckling of the connection straps (31) with the corresponding connection straps (14) of the backpack (1). Hence, the loading capacity of goods carried by users can thereby be increased.

Figure 3:
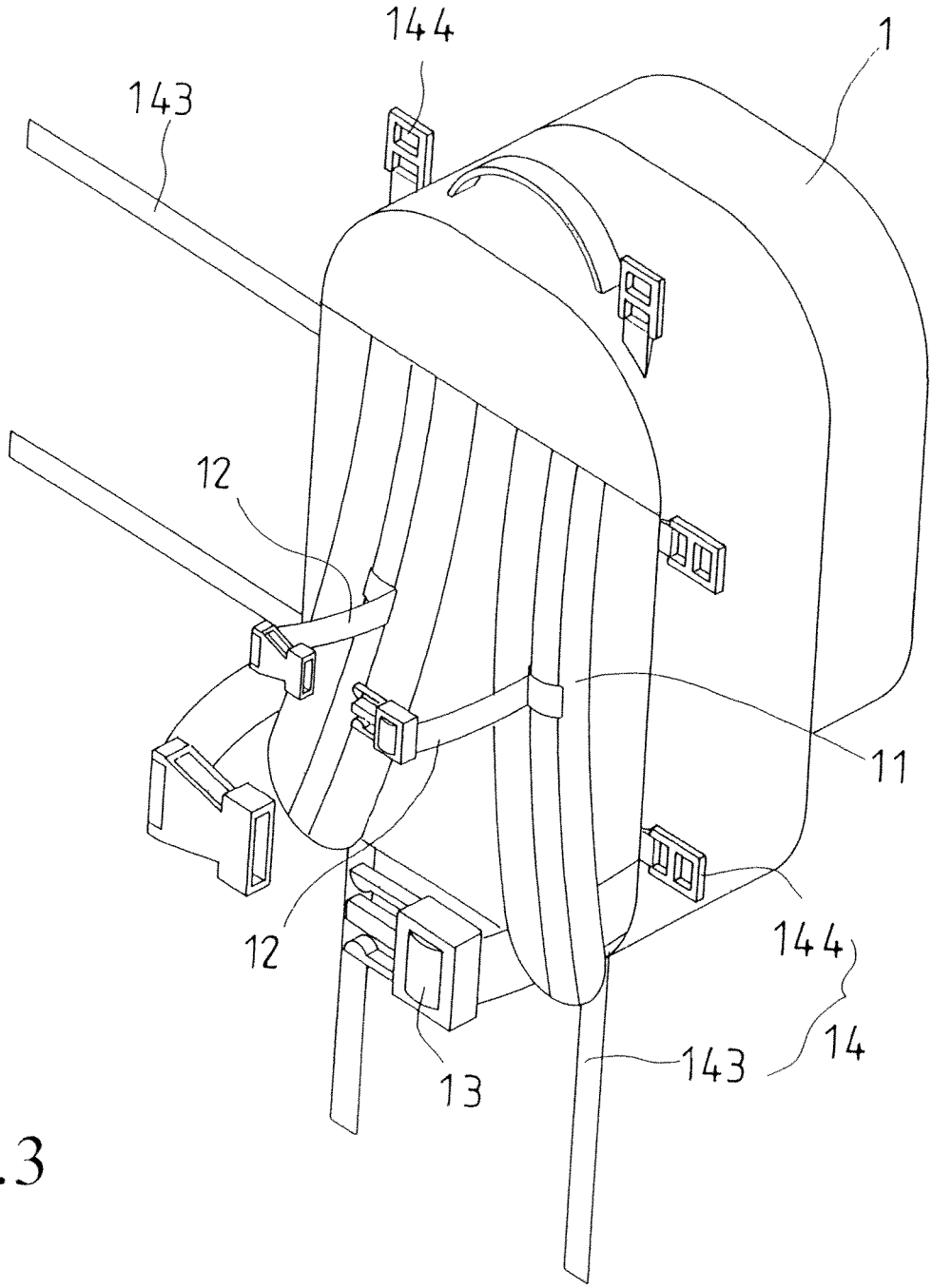
FIG. 3 is a perspective view showing another embodiment of the backpack of the present invention.
Figure 4:
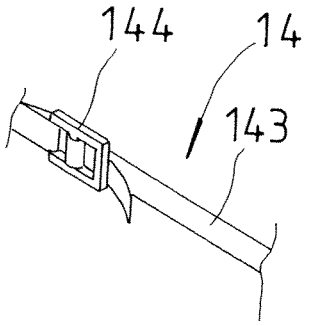
FIG. 4 is a schematic view showing the combination state of another embodiment of the backpack of the present invention.
Figure 5:
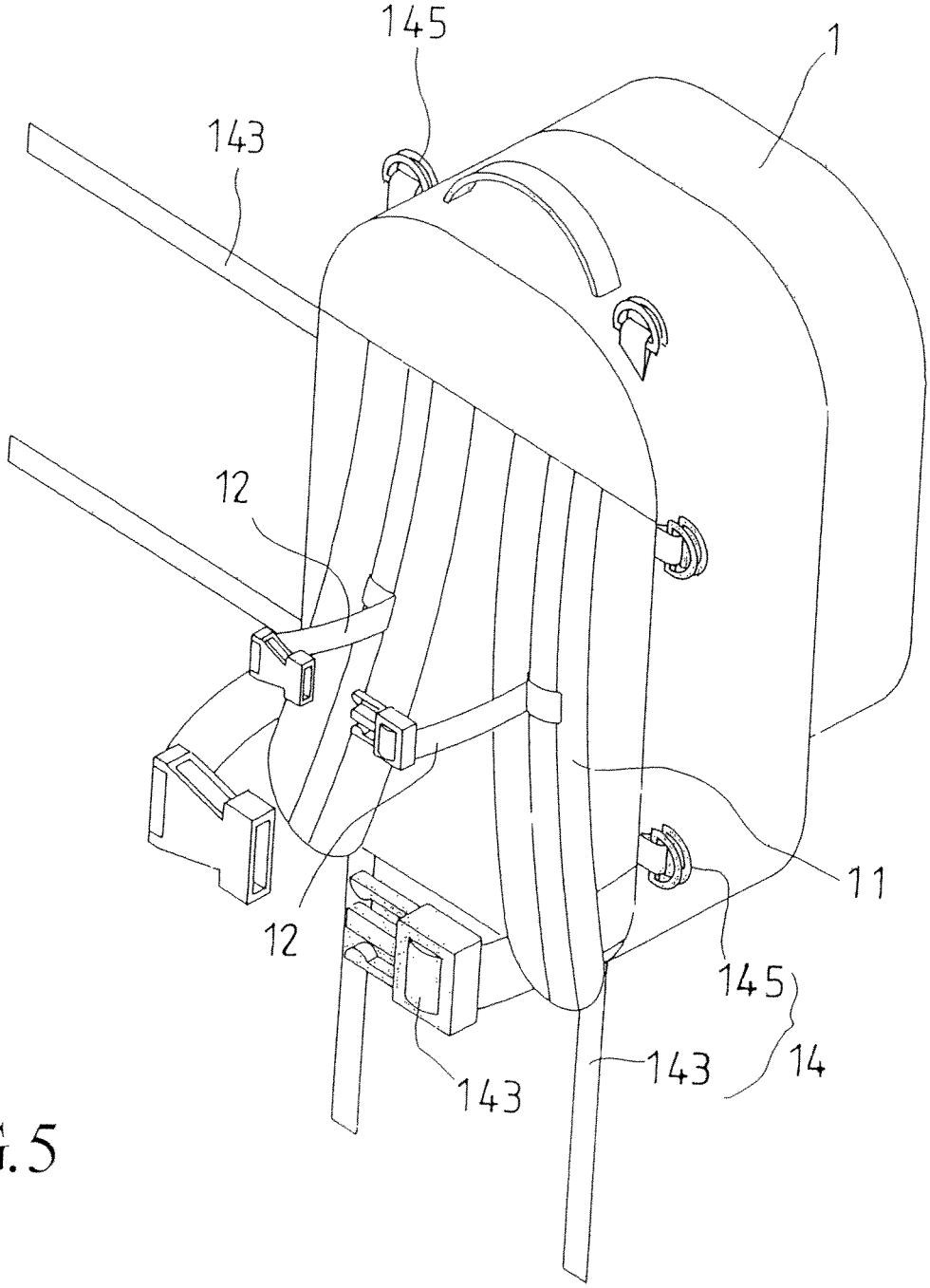
FIG. 5 is a perspective view showing still another embodiment of the backpack of the present invention.
Figure 6:
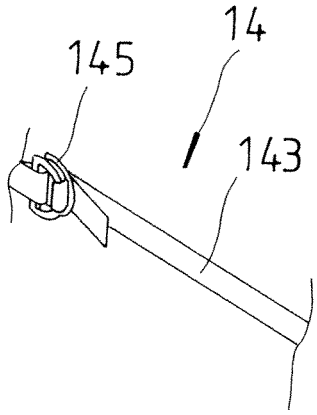
FIG. 6 is a schematic view showing the combination state of another embodiment of the backpack of the present invention.

The connection straps (14) of the backpack (1) have a male buckle (141) on one side and a matching female buckle (142) on the other side. Two backpacks (1) can be combined together by the buckling of the male buckle (141) and the corresponding female buckle (142). Further referring to FIG. 3, the connection straps (14) of the backpack (1) have a strap (143) one side and a cooperating buckle (144) on the other side so that two backpacks (1) can be combined together by penetrating the strap (143) inside the cooperating buckle (144) so as to be fastened in a manner as shown in FIG. 4. FIG. 5 is a perspective view showing still another embodiment of a backpack of the present invention. As shown in the figure, the connection straps (14) of the backpack (1) have a strap (143) on one side and a cooperating pair of D rings (145) on the other side so that two backpacks (1) can be combined together by penetrating the strap (143) inside the pair of D rings (145) to be fastened in a manner as shown in FIG. 6.

Figure 7:
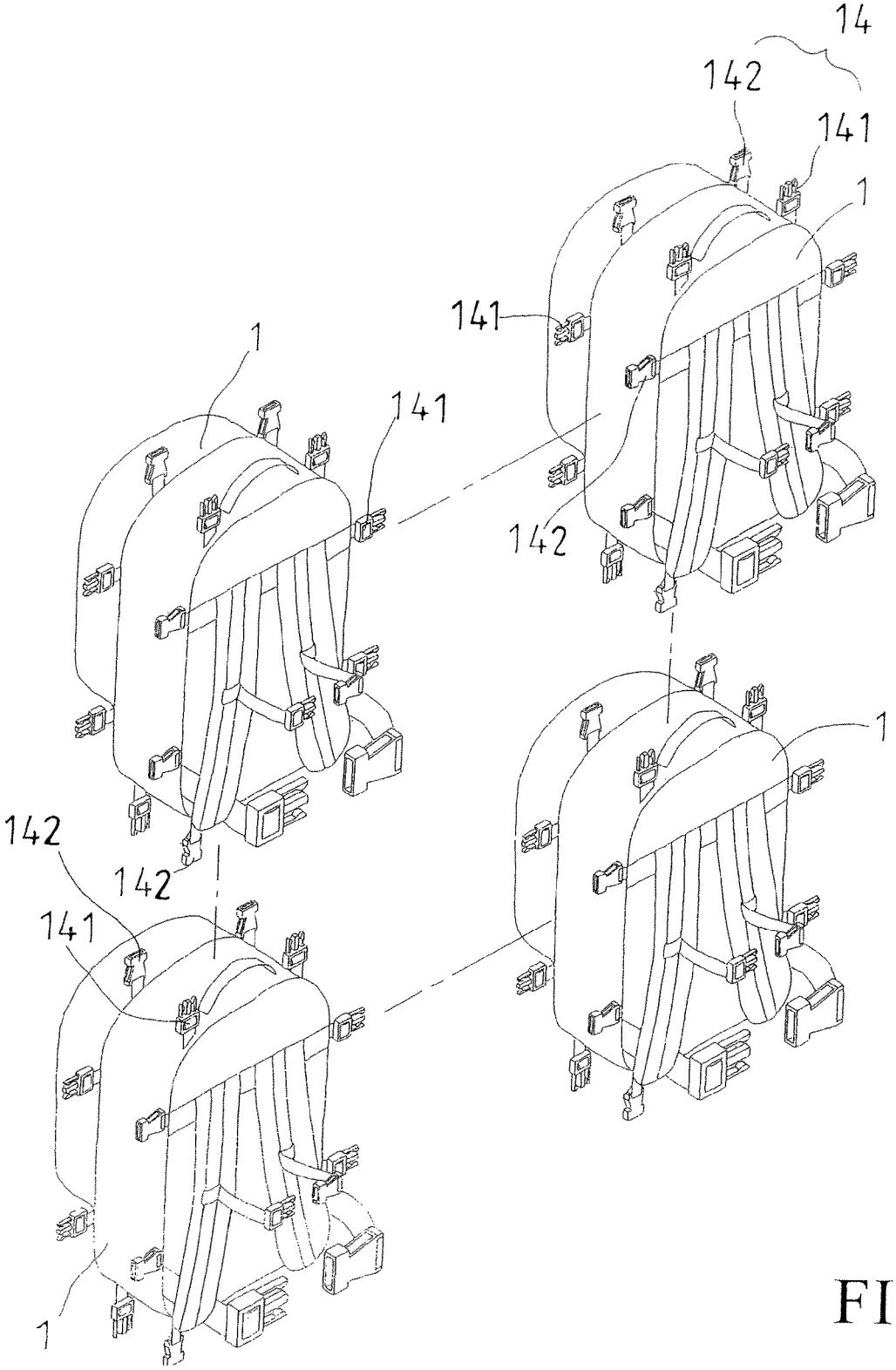
FIG. 7 is a schematic exploded view showing the combination state of usage of the backpacks of the present invention.
Figure 8:
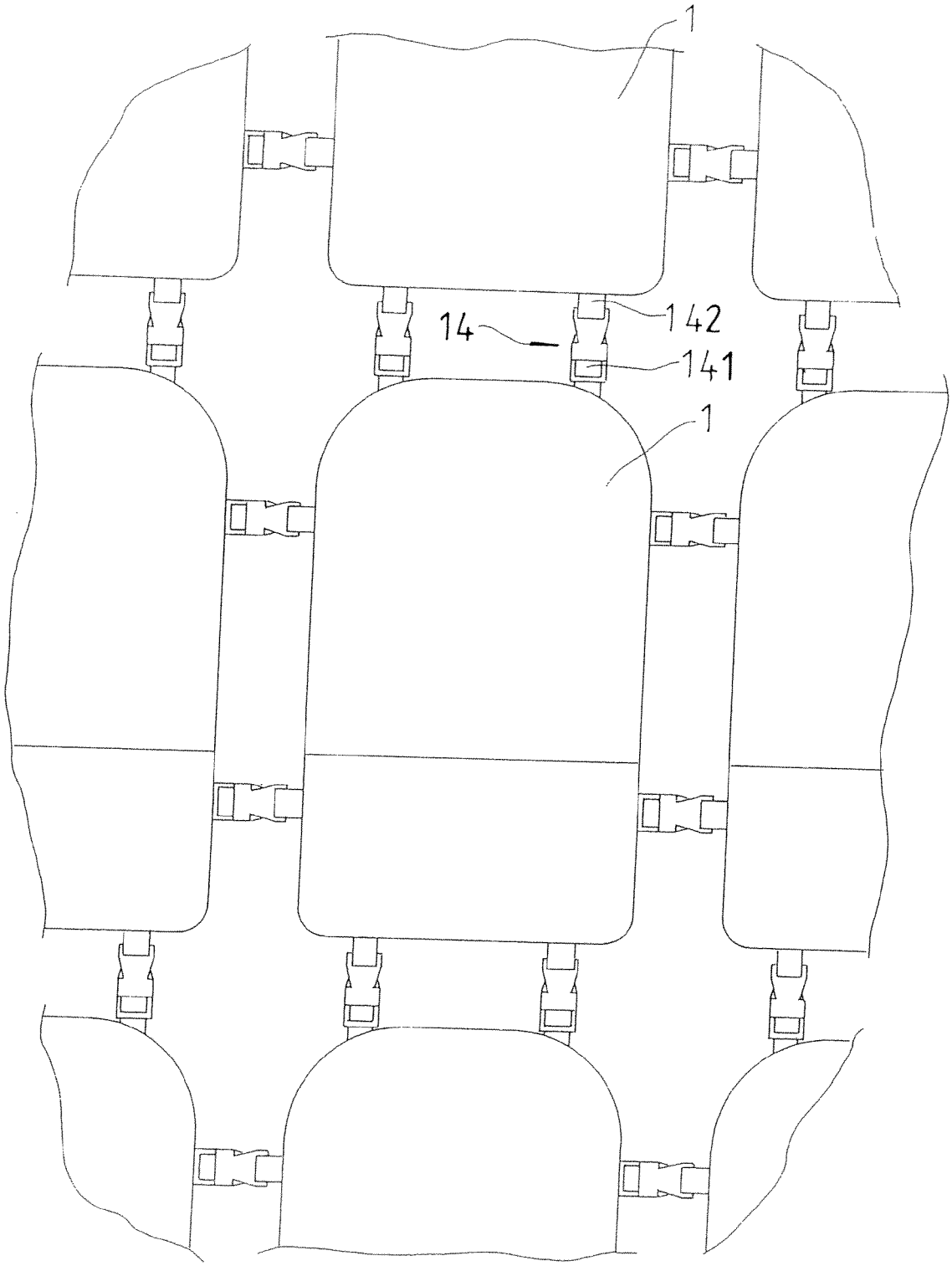
FIG. 8 is a schematic exploded view showing the combination state of usage of the backpacks of the present invention.

Configuring a plurality of backpacks as shown in FIGS. 7 and 8, wherein the plurality of backpacks (1) are laid down in matrix arrangement. Each backpack (1) can be combined with neighboring backpacks (1) by the buckling of its upper, lower, left and right connection straps (14) with that of the neighboring backpacks (1) so that the backpacks (1) are formed into a planar matrix configuration. In addition, as the backpacks (1) are made of materials capable of floating on water, such as plastic material, EVA etc., the backpacks (1) formed into the matrix configuration will float on water, when immersed in water. Hence, it can be used to carry personnel or goods for crossing a river or for emergency relief on water.

Alternatively, the water contained in each water bag disposed inside the backpack (1) can be poured out after the water bag (2) is taken out from the backpack (1), and then the water bag (2) filled with air. In turn, the backpack (1) is then combined with the two air filled water bags (2) on both sides thereof by the buckling of its connection straps (14) with the connection straps (21) of the water bags (2). When a user carries the backpack (1) on his back by the shoulder straps (11), he can allow the backpack (1) to be carried more stably on his back by simultaneously buckling the chest straps (12) at his chest and the waist straps (13) at his waist. When crossing a river, not only does the material of the backpack (1) itself provide buoyancy, but the air filled in the water bags (2) that are connected at both sides of the backpack (1) further contribute to the buoyancy of the backpack (1). Thus, this arrangement can facilitate a user's ability to cross a river.

Figure 9:
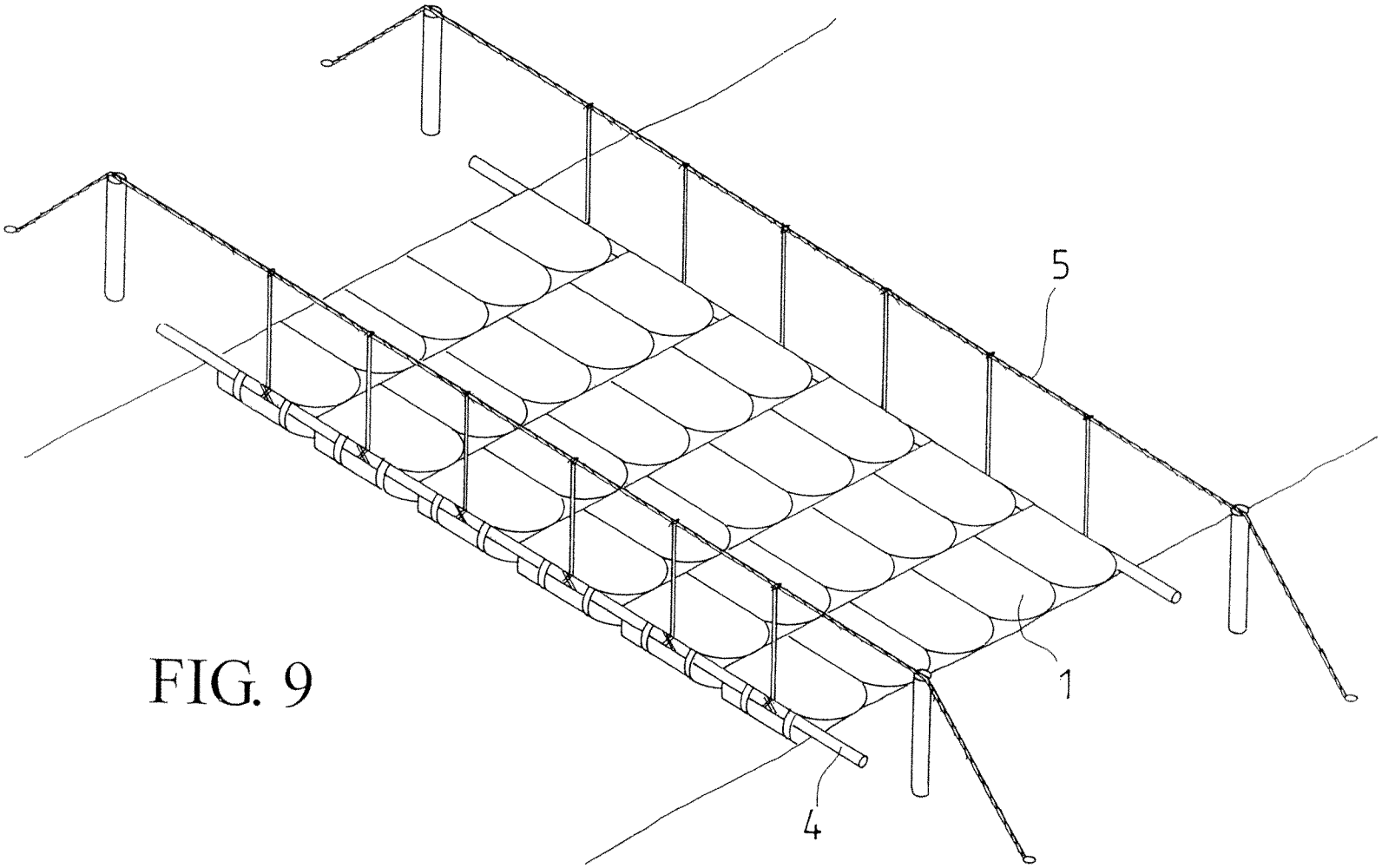
FIG. 9 is another schematic view showing the state of usage of the backpacks of the present invention.

Referring to FIG. 9, a plurality of the backpacks (1) of the present invention can be aligned in matrix arrangement to match the width of a river. Then, the backpacks (1) can be combined together by the buckling of their upper, lower, left and right connection straps (14) with that of the neighboring backpacks (1) so that the backpacks (1) are formed into a planar matrix configuration. Further, the connection straps (14) of the outermost backpacks (1) at both ends are tied up with rods (4) spanning between both sides of the river. As the backpacks (1) are made of materials capable of floating on water, the backpacks (1), formed into a planar matrix, spanning over the river can float on the water to serve as a bridge. When the backpacks (1) spanning over the river are used as a bridge, ropes or other rods can be provided above the rods (4), spanning between both sides of river, to serve as armrests (5), so as to enhance convenience and safety in crossing the river. Aforementioned embodiments and drawings are not to restrict the product structure or implementation modes. Appropriate variations and modifications done by those people having general knowledge in the art without departing from the scope and features of the present invention are considered to be still within the scope of the present invention.

What is claimed is:

1. A backpack arrangement having a lifesaving function, comprising:

a plurality of backpacks, each of said plurality of backpacks being made of materials capable of floating on water and having connection straps (14) being provided on each of upper, lower, left and right end faces of said backpack (1), said connection straps (14) being configured for releasable securement to respective connection straps (14) of other of said plurality backpacks (1);

wherein said plurality of backpacks are disposed in a planar matrix arrangement, said planar matrix arrangement being formed by interconnecting said connection straps on at least two of said upper, lower, left and right end faces of one of said plurality of backpacks with corresponding connection straps of adjacent backpacks in said planar matrix arrangement.

2. The backpack arrangement having a lifesaving function as claimed in claim 1, wherein said connection straps (14) of each said backpack (1) have at least one male buckle (141) at one end face and at least one mating female buckle (142) at an opposing end face.

3. The backpack arrangement having a lifesaving function as claimed in claim 1, wherein said connection straps (14) of each said backpack (1) have at least one strap (143) at one end face and at least one cooperating buckle (144) at the other side an opposing end face.

4. The backpack arrangement having a lifesaving function as claimed in claim 1, wherein said connection straps (14) of each said backpack (1) have at least one strap (143) at one end face and at least one pair of D rings (145) cooperating at an opposing end face.

5. The backpack arrangement having a lifesaving function as claimed in claim 1, wherein said connection straps (14) of each said backpack (1) have at least one male buckle (141) and at least one mating female buckle (142) at each of said upper, lower, left and right end faces, said male buckles (141) on each said end face being positioned to correspond to a respective one of said female buckles (142) on an opposing end face.

6. A backpack arrangement having a lifesaving function, comprising:

a plurality of backpacks, each of said plurality of backpacks being is made of materials capable of floating on water and having respective pairs of connection straps (14) being provided on each of upper, lower, left and right end faces of said backpack (1), said connection straps (14) being configured for releasable securement with corresponding connection straps (14) of other of said plurality backpacks (1), each of said backpacks having water bags (2) removably secured therein, each of said water bags having a closed space being formed therein configured for holding either water or air in said closed space, each said water bag (2) having connection straps (21) fastened thereto;

wherein said plurality of backpacks are disposed in a planar matrix arrangement, said planar matrix arrangement being formed by interconnecting said pairs of connection straps on at least two of said upper, lower, left and right end faces of one of said plurality of backpacks with corresponding pairs of connection straps of respective end faces of adjacent backpacks in said planar matrix arrangement.

7. The backpack arrangement having a lifesaving function as claimed in claim 6, wherein each said pair of connection straps (14) of each of said plurality of backpacks (1) has a male buckle (141) and a mating female buckle (142) at each of said upper, lower, left and right end faces, said male buckles (141) on each said end face being positioned to correspond to a respective one of said female buckles (142) on an opposing end face.

* * * * *